US007461491B1

(12) United States Patent
Sorkin

(10) Patent No.: US 7,461,491 B1
(45) Date of Patent: Dec. 9, 2008

(54) INTERSECTIONAL REINFORCING BAR SUPPORT HAVING SECURING CAP

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 414 days.

(21) Appl. No.: 11/234,756

(22) Filed: Sep. 26, 2005

(51) Int. Cl.
*E04C 5/16* (2006.01)

(52) U.S. Cl. ..... 52/685; 52/679; 52/686; 52/687; 52/689; 52/719

(58) Field of Classification Search ..... 52/685, 52/686, 687, 689, 677, 719; 248/74.2
See application file for complete search history.

(56) References Cited

U.S. PATENT DOCUMENTS

| | | | | | |
|---|---|---|---|---|---|
| 3,105,423 | A * | 10/1963 | Reiland | ..... | 52/677 |
| 3,673,753 | A | 7/1972 | Anderson | | |
| 3,788,025 | A * | 1/1974 | Holmes | ..... | 52/685 |
| 4,835,933 | A * | 6/1989 | Yung | ..... | 52/685 |
| 5,555,693 | A | 9/1996 | Sorkin | | |
| 5,791,095 | A | 8/1998 | Sorkin | | |
| 5,791,816 | A * | 8/1998 | McCallion | ..... | 404/136 |
| 5,893,252 | A | 4/1999 | Hardy, Jr. et al. | | |
| 6,112,494 | A | 9/2000 | Hardy, Jr. et al. | | |
| 6,276,108 | B1 * | 8/2001 | Padrun | ..... | 52/684 |
| 6,663,316 | B1 * | 12/2003 | Harris | ..... | 404/136 |
| 6,684,594 | B1 | 2/2004 | Sorkin | | |
| D500,665 | S | 1/2005 | Sorkin | | |
| 7,143,563 | B1 * | 12/2006 | Palmer | ..... | 52/677 |
| 2003/0000170 | A1 * | 1/2003 | Sorkin | ..... | 52/677 |

* cited by examiner

*Primary Examiner*—Richard E. Chilcot, Jr.
*Assistant Examiner*—Anthony N Bartosik
(74) *Attorney, Agent, or Firm*—Egbert Law Offices

(57) ABSTRACT

A concrete reinforcing bar support has a base, a support structure extending upwardly from the base and a having a channel formed in an upper surface thereof, a first clamping structure affixed to the support structure on one side of the channel and second clamping structure affixed to the support structure on an opposite side of the channel. Each of the first and second clamping structures includes a first C-shaped member and a second C-shaped member extending flexibly upwardly from the support structure and facing in opposite directions. A cap is slidably affixed over these C-shaped members and the channel.

11 Claims, 2 Drawing Sheets

INTERSECTIONAL REINFORCING BAR SUPPORT HAVING SECURING CAP

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for use in connection with construction. More particularly, the present invention relates to reinforcing bar chair apparatus for use in reinforced concrete construction. Furthermore, the present invention relates to intersectional chairs used with reinforced concrete construction.

BACKGROUND OF THE INVENTION

In reinforced concrete construction applications, such as highways, floors, or walls of buildings, spacer devices, commonly referred to as chairs, are required for supporting and maintaining reinforcing rods or bars which are positioned in the area where concrete is to be poured. These reinforcing rods are sometimes referred to as "rebars". Depending on such parameters, such as the total surface area and the thickness of the end product of concrete, reinforcement is mandated in varying degrees by building codes. One such method of reinforcement involves a steel mesh, while in major concrete construction, such as highways and high-rise buildings, reinforcing rods of various diameters, typically one-half inch or more, are required. In addition, on such jobs, the reinforcing bars may be positioned in spaced layers due to the thickness of the floor. In some installations, a first layer of rebar is provided, with the reinforcing rods or rebars in spaced parallel relationship, and generally parallel to the surface on which the concrete is to be poured. A second layer of rebar is then added, with the orientation of the second layer perpendicular to the first layer, thus forming a grid or lattice work. After the reinforcing bars or lattice work is prepared, the concrete is then poured over this grid or framework, which is ultimately embedded within the highway floor or wall.

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modem building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc. and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or decomposing of the wire or metal components.

In the past, various patents have issued relating to these chair supports for reinforcing rods. In particular, the present inventor is the owner of U.S. Pat. Nos. 5,555,693 and 5,791,095 for such chairs. Each of these chairs has a receiving area with a horizontal section and a generally parabolic section extending transverse to the horizontal section. A plurality of separate legs extends downwardly from the receiving area. Each of the legs has a foot extending horizontally outwardly therefrom. The receiving area and the plurality of legs are integrally formed together of a polymeric material.

U.S. Pat. No. 3,788,025, issued on Jan. 29, 1974 to S. D. Holmes, describes a chair for supporting in right angular relation two reinforcing rods used in construction. The chair has a lower arched base part and an upper rod supporting part integral with the base. The base is an arched support with means for providing lateral, longitudinal, vertical support and strength. The rod supporting part comprises two spaced apart arms, the lower parts of which form a saddle for receiving one reinforcing rod and the upper part for each of which is formed by two separate spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972 to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933 issued on Jun. 6, 1989 to F. P Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof in spaced generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,892, issued on Apr. 13, 1999 to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snaptype lock for attaching to the arc-type portion and engaging with the snap-type lock of the arc-type portion. A leg portion extends downwardly from the holding portion and is integrally attached to a base.

U.S. Pat. No. 6,112,494, issued on Sep. 5, 2004 to Hardy, Jr. et al., teaches a system for affixing rebar lattice. The apparatus includes a holding portion having an open ended recess with two opposing walls being generally U-shaped. The recess has a longitudinal axis and is sized and shaped to receive a longitudinal rod. An arc-shaped portion extends latteral outwardly from each opposing wall and perpindicular to the longitudinal axis of the recess. The arc-shaped portion includes a recess and opposing walls with wall including a snap-type lock. A locking member having a generally arc-shaped portion and includes a snap-type lock for attaching to the arc-shaped portions and engaging with the snap-type lock of the arc-shaped portions. A holding member is adapted to secure the individual longitudinal and transverse rebar intersections of the rebar lattice in a locking relationship while the leg portion holds the interconnected rebar lattice in a preselected elevated position.

The present inventor is the owner of several U.S. patents relating to such intersectional rebar chairs. For example U.S. Pat. No. 6,684,594, issued on Feb. 3, 2004 to the present inventor, describes a concrete reinforcing bar support having a base, a support structure extending upwardly from the base and a having a channel formed in an upper surface thereof, a first clamping structure affixed to the support structure on side of the channel, and a second clamping structure affixed to the support structure on an opposite side of the channel. A first rebar extends through the channel. A second rebar is retained by the first and second clamping structures in a direction transverse to the first rebar. The retaining elements are provided on the clamping structures so as to engage the rebar when it is received within the second clamping structure. Lever elements extend outwardly from the clamping structure so as to provide a funneling type of structure so as to facilitate the introduction of the rebar into the second clamping structure.

U.S. Pat. No. 6,684,595, issued on Feb. 3, 2004 to the present inventor, teaches another type of intersectional reinforcing bar support. This bar support also includes a base, a support structure extending upwardly from the base and having a channel formed at an upper surface thereof, a first clamping structure affixed to the support structure on side of the channel, and a second clamping structure affixed to the support structure on an opposite side of the channel. Each of the clamping structures has a curved element extending inwardly therefrom. A first rebar extends through the channel. A second rebar is retained by the first and second clamping structures in a direction transverse to the first rebar. A self adjusting retention mechanism is provided on a side of the second clamping structure opposite the curved surface so as to retain the rebar in a proper position therein.

U.S. Design Pat. No. D500,665, issued on Jan. 1, 2005 to the present inventor, teaches a unique design for such an intersectional rebar chair. A channel is formed at the top of the support structure. A pair of C-shaped clamping structures are located on opposite sides of the channel. The lipped element extends across the open face of the C-shaped members so as to facilitate the introduction of rebar into the interior of such C-shaped members.

It is an object of the present invention to provide a bar support which is corrosion-proof.

It is another object of the present invention to provide a bar support adapted for use at intersections of rebars.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support which allows a free flow of concrete therethrough.

It is a further object of the present invention to provide a bar support with a load-resistant stable support structure.

It is a further object of the present invention to provide a reinforcing bar support which is easy to use, easy to manufacture and relatively inexpensive.

It is another object of the present invention to provide a channel for such an intersectional chair which is suitably reinforcing so as to enhance the ability to retain the rebar within the channel.

It is a further object of the present invention to provide an intersectional chair whereby a cap can be secured over the top of the chair so as to retain the rebars therein.

It is an other object of the present invention to provide an intersectional chair that has a cap covering whereby the cap covering can be slidably installed in a simple and efficient manner.

These and other objects and advantages of the present invention will become apparent from the reading of the attached specification and appended claims.

BRIEF SUMMARY OF THE INVENTION

The present invention is a concrete reinforcing bar support that comprises a base, a support structure extending upwardly from the base and having a channel formed in an upper surface thereof, a first clamping structure affixed to the support structure on one side of the channel, and a second clamping structure affixed to the support structure on an opposite side of the channel in spaced relationship to the first clamping structure. The channel extends in a direction and has a size suitable for receiving a first rebar therein. The first clamping structure has an interior surface suitable for receiving a second rebar therein and extending in a direction transverse to the first rebar. The second clamping structure has an interior surface suitable for receiving the second rebar therein. Each of the first and second clamping structures includes a first C-shaped member extending flexibly upwardly from the support structure and a second C-shaped member extending flexibly upwardly from the support structure. The first and second C-shaped members face in opposite directions.

The first C-shaped member of the first and second clamping structures us located between the second C-shaped members and a respective side of the channel. The first C-shaped member of the clamping structures face in the same direction while the second C-shaped members of the clamping structures face in the same direction.

In the present invention, the support structure has a first reinforcing rib extending vertically upwardly therealong from the base to said first C-shaped member. This first reinforcing rib extends along a back of the first C-shaped member. The support structure has a second reinforcing rib extending vertically upwardly therealong from the base to the second C-shaped member. This second reinforcing rib extends along a back of the second C-member. Each of the first and second C-shaped members has a flange element extending angularly upwardly and outwardly therefrom.

In the present invention, a cap slidably affixed over the first and second C-shaped members and over the channel. The cap has a pair of slots formed on opposite sides thereof. This pair of slot slidably engaging the flange elements of the first and second C-shaped members. Each of the pair of slots is open at one end and closed at an opposite end thereof. The cap has a curved surface extending between the pair of slots. This curved surface has a shape generally conforming to an outer surface of a rebar extending through the first and second clamping structures.

In the present invention, the channel includes a generally semi-cylindrical channel extending outwardly of a first side and a second side of the support structure. A first gusset extends between a bottom of channel and a first side of support structure. A second gusset extends between a bottom of a channel and the second side of support structure.

DETAILED DESCRIPTION OF THE INVENTION

Figure 1:
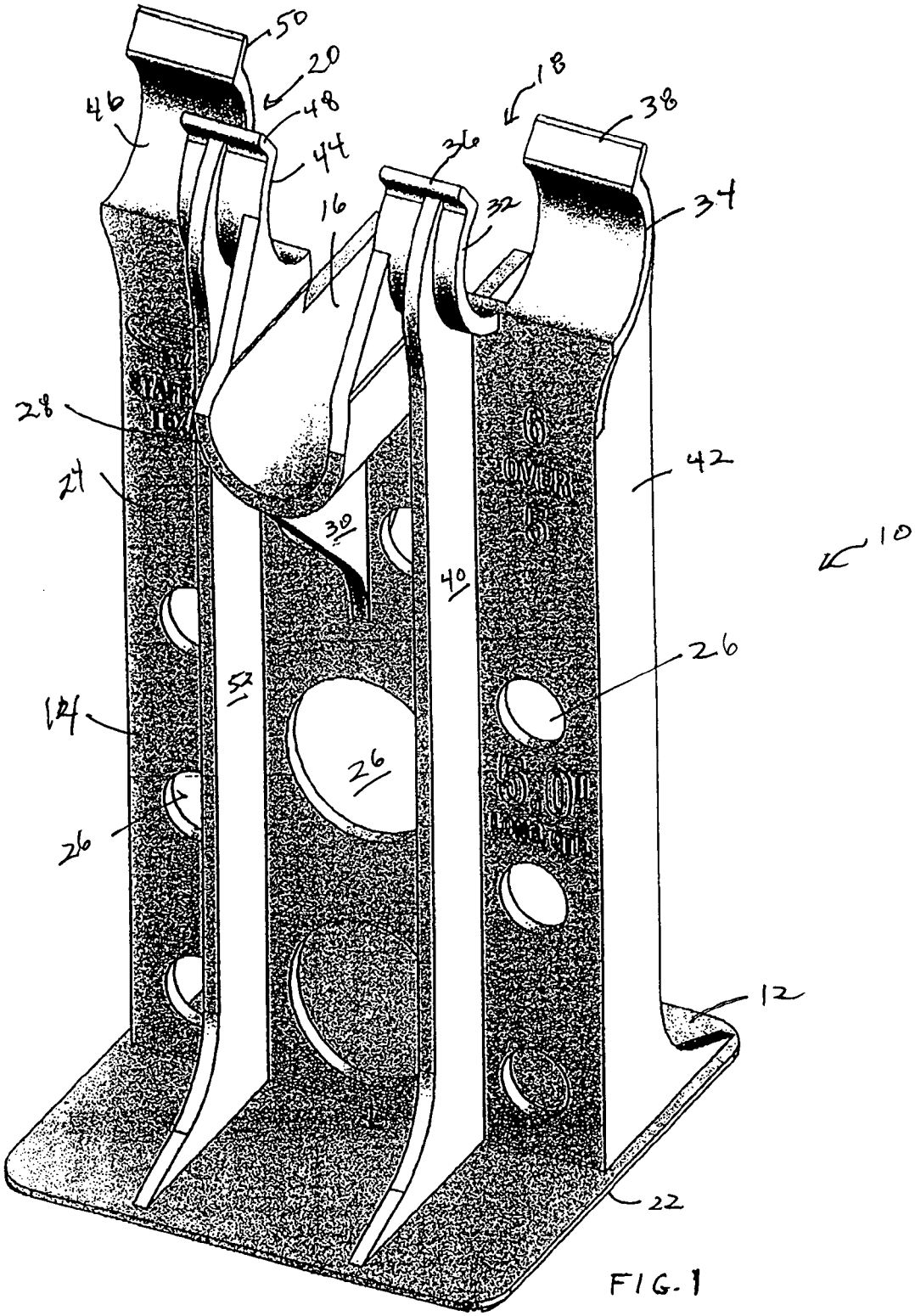
FIG. 1 is a perspective view of the bar suitable in accordance with preferred embodiment of the present invention.

Referring to FIG. 1, there is shown the intersectional bar support 10 in accordance with the preferred embodiment of the present invention. The insectional bar support 10 includes a base 12 having a support structure 14 extending upwardly therefrom. A channel 16 is formed at an upper surface of the support structure 14. A first clamping structure 18 is affixed to the support structure 14 on one side of the channel 16. A second clamping structure 20 is affixed to the support structure 14 on an opposite side of the channel 16 and in spaced relationship to the first clamping structure 18. The channel 16 extends in a direction and has a size suitable for receiving a first rebar therein. The first clamping structure 18 has an interior suitable for receiving second rebar therein extending in a direction transverse to the first rebar. Similarly, the second clamping structure 20 has an interior suitable for receiving the second rebar therein.

The base 12 has a generally flat bottom surface 22. The base 12 facilitates the ability of the bar support 10 to be placed upon a flat underlying surface. The support structure 14 is formed with the base 12 and extends vertically upwardly therefrom.

The base 14 includes a wall 24 having a plurality of openings 26 formed therethrough. The openings 26 facilitate the ability of concrete to flow through the wall 24 and through the support structure 14. Additionally, the openings 26 facilitate the ability to establish a strong sealing relationship between the support structure 14 and the concrete into which the support structure 14 is placed. The base 12 and the support structure 14 are integrally formed together in an injection molding process and formed of a polymeric material.

The channel 16 is formed centrally of the support structure 14 generally at the top thereof. The channel 16 includes a generally semi-cylindrical channel 28 extending outwardly of a first side of the support structure 14 and outwardly of a second side of the support structure 14. A first gusset 30 extends between a bottom of the channel 28 and the first side support structure 24. As will be seen in FIG. 2, a second gusset will also extend between the bottom of the semi-cylindrical channel 28 and the second side of the support structure 14. The channel 24 will have a size suitable for allowing a rebar to be received therein.

The first clamping structure 18 is located on one side of the channel 16 at the top of the support structure 14. The first clamping structure 18 includes a first C-shaped member 32 and a second C-shaped member 34. The first C-shaped member 32 extends flexibly upwardly from the support structure 14. Similarly, the second C-shaped member 34 also extends flexibly upwardly from the support structure 14. The first C-shaped member 32 faces in a direction opposite to that of the second C-shaped member 34. The first C-shaped member 32 is located between the second C-shaped member 34 and the channel 16. A first flange element 36 extends angularly upwardly and outwardly of the first C-shaped member 32. A second flange element 38 extends upwardly and outwardly of the second C-shaped member 34. These flange elements 36 and 38 facilitate the ability to introduce a rebar into the space between the first C-shaped member 32 and the second C-shaped member 34. Additionally, the flange elements 36 and 38 allow for a cap to be slidably affixed thereover and thereto.

A reinforcing rib 40 extends upwardly from the base 12 toward the first C-shaped member 32. The reinforcing rib 40 has a wide portion at the base 12 and extends transversely outwardly of the wall 24 of support structure 14. The reinforcing rib 40 will also extend around the back of the first C-shaped member 32 so as to terminate at the flange element 36. The placement of the reinforcing rib 40 in the position illustrated in FIG. 1 enhances the structural integrity of the first C-shaped member 32 and the integrity of the support structure 14. This reinforcing rib 40 will resist the deflection of the support structure 14 upon the application of a compressive load thereto. A second reinforcing rib 42 will extend on the opposite side of the support structure 14. The second reinforcing rib 42 has a wide end at the base 12. The second reinforcing rib 42 extends upwardly from the base 12 and transversely outwardly of the support structure 14 in generally parallel planar relationship with the first reinforcing rib 40. The second reinforcing rib 42 will extends across the back of the second C-shaped member 34 and will terminate at the second flange element 38. As such, structural integrity is imparted to the opposite side of the support structure 14 through the reinforcing rib 42. Unnecessary deflection of the second C-shaped member 34 is effectively avoided through the placement of the reinforcing rib 42.

The second clamping structure 20 has a similar configuration to that of the first clamping structure 18. In particular, the second clamping structure 20 includes a first C-shaped member 44 and a second C-shaped member 46. A flange element 48 extends upwardly and outwardly of the top of the first C-shaped member 44. A flange element 50 extends upwardly and outwardly of the second C-shaped member 46 of the second clamping structure 20. The first clamping structures 32 and 44 face in the same direction. The first C-shaped member 44 is interposed between the second C-shaped member 46 and the opposite side of the channel 16 from the first clamping structure 18. The second C-shaped members 34 and 46 also face in the same direction. Another reinforcing rib 52 extends in parallel relationship to reinforcing rib 40 in a similar manner to that described in association with the first clamping structure 18. The clamping structures 18 and 20 are similarly integrally formed with the support structure 14 in an injection molding process.

Figure 2:
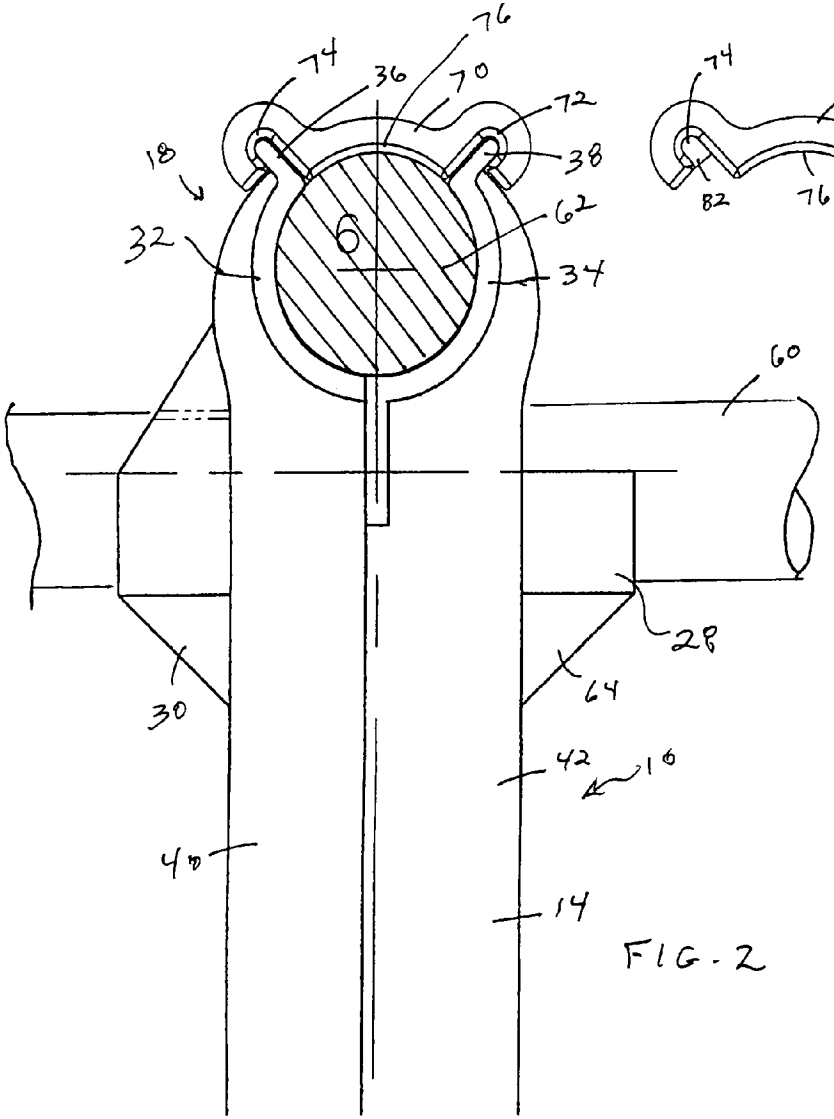
FIG. 2 is an end view of the intersectional bar support of the present invention showing the rebar extending through the channel and the clamping structures and also showing the cap as secured over the first and second clamping structures.

FIG. 2 illustrates the manner in which the first rebar 60 and the second rebar 62 are retained within the bar support 10 of the present invention. In FIG. 2, it can be seen that the semi-cylindrical channel 28 has rebar 60 extending therethrough. The first gusset 30 supports one end of the channel 28. Another gusset 64 supports an opposite end of the channel 28. The channel 28 extends outwardly on opposite side of the support structure 14.

In FIG. 2, it can be seen that the rebar 62 is retained between the C-shaped members 32 and 34 of the clamping structure 18. The C-shaped member 32 is reinforced by the reinforcing rib 40 extending along the support structure 14. Similarly, the second C-shaped member 34 is reinforced by reinforcing rib 42 that also extends along the support structure 14. The reinforcing rib 62 has a bottom which resides in close proximity to the top of the rebar 60. It can be seen that the rebar 60 extends in a direction transverse to that of the rebar 62.

Figure 3:
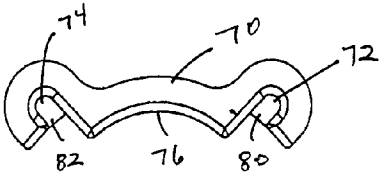
FIG. 3 is a isolated end view of the cap as used on the intersectional bar support of the present invention.

Importantly, in FIG. 3, it can be seen that a cap 70 is affixed over the top of the rebar 62. Cap 70 includes a first slot 72 and a second slot 74. The first slot 72 is slidably received over the flange element 38 of the C-shaped member 34. Similarly, the slot 74 is received over the flange element 36 of the first C-shaped member 32. The cap 70 has a curved surface 76 that generally conforms to the exterior surface of the rebar 62. The configuration of flange elements 36 and 38 allows the cap 70 to be easily slidably placed over the top of the rebar 62 so that the rebars 60 and 62 are securely retained in place within the bar support 10.

FIG. 3 shows an isolated view of the cap 70. It can be seen that the cap 70 includes slots 72 and 74. Curved surface 76 extends between the slots 72 and 74. Each of the slots 72 and 74 are closed at the opposite end thereof. As such, the closed surfaces 80 and 82 at the ends of the slots 72 and 74, respectively, limit the slidable action of the cap 70 over the flange elements 36 and 38. These closure surfaces 80 and 82 avoid any accidental dislocation of the cap 70 from its position over the rebar 62 on the respective clamping surfaces of the bar support 10.

Figure 4:
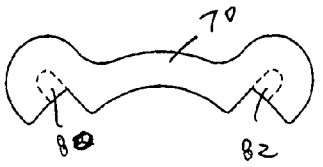
FIG. 4 is an opposite end view of the cap as used on the intersectioanl bar support of the present invention.

FIG. 4 illustrates the opposite end of the cap 70 in which the closed surfaces 80 and 82 cover the respective slots 72 and 74.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A concrete reinforcing bar support comprising:

a base; a support structure extending upwardly from said base, said support structure having a channel formed in an upper surface thereof, said channel extending in a direction and having a size suitable for receiving a first rebar therein;

a first clamping structure affixed to said support structure on one side of said channel, said first clamping structure having an interior surface suitable for receiving a second rebar therein extending in a direction transverse to the first rebar;

a second clamping structure affixed to said support structure on an opposite side of said channel, said second clamping structure having an interior surface suitable for receiving the second rebar therein, said second clamping structure being in spaced relationship to said first clamping structure, each of said first and second clamping structures comprising:

a first C-member extending flexibly upwardly from said support structure; and a second C-shaped member extending flexibly upwardly from said support structure, said first and second C-shaped members facing in opposite directions, each of said first and second C-shaped members having a flange element extending angularly upwardly and outwardly therefrom; and a cap having a first slot and second slot extending longitudinally along opposite sides thereof, said first slot slidably engaging the flange elements of the first C-shaped member of said first and said second clamping structures and said second slot slidably engaging the flange elements of the second C-shaped member of said first and said second clamping structures.

2. The bar support of claim 1, said first C-shaped member of said first and second clamping structures located between said second C-shaped member and a respective side of said channel.

3. The bar support of claim 2, said first C-shaped member of said first and second clamping structures facing in the same direction, said second C-shaped member of said first and second clamping structures facing in the same direction.

4. The bar support of claim 1, said support structure having a first reinforcing rib extending vertically upwardly therealong from said base to said first C-shaped member of said first and second clamping structures, said first reinforcing rib extending along a back of said first C-shaped member of said first and second clamping structures.

5. The bar support of claim 4, said support structure having a second reinforcing rib extending vertically upwardly therealong from said base to said second C-shaped member of said first and second clamping structures, said reinforcing rib extending along a back of said second C-shaped member of said first and second clamping structures.

6. The bar support of claim 1, each of said pair of slots being open at one end thereof and closed at an opposite end thereof.

7. The bar support of claim 1, said cap having a curved surface extending between said pair of slots, said curved surface having a shape generally conforming to an outer surface of a rebar extending through said first and second clamping structures.

8. The bar support of claim 1, said channel comprising:

a generally semi-cylindrical channel extending outwardly of a first side and a second side of said support structure;

a first gusset extending between a bottom of channel and said first side of support structure; and a second gusset extending between a bottom of said channel in said second side of said support structure.

9. A concrete reinforcing bar support comprising: a base;

a support structure extending upwardly from said base, said support structure having a channel formed in an upper surface thereof;

a first clamping structure affixed to said support structure on one side of said channel;

a second clamping structure affixed to said support structure on an opposite side of said channel, said second clamping structure being in spaced relationship to said first clamping structure;

a first rebar extending through said channel;

a second rebar extending in a direction transverse to said first rebar, said second rebar extending through said first and second clamping structures; and a cap affixed on said first and second clamping structures and over said first and second rebars, each of said first and second clamping structures comprising:

a first C-shaped member extending flexibly upwardly from said support structure; and a second C-shaped member extending flexibly upwardly from said support structure, said first and second C-shaped members facing in opposite directions to each other, each of said first and second C-shaped members having a flange element extending angularly upwardly and outwardly therefrom, said cap having a first slot and second slot extending longitudinally along opposite sides thereof, said first slot slidably engaging the flange elements of the first C-shaped member of said first and said second clamping structures and said second slot slidably engaging the flange elements of the second C-shaped member of said first and said second clamping structures, each of said slots being open at one end thereof and closed at an opposite end thereof.

10. The bar support of claim 9, said cap slidably engaged with said first and second clamping structures.

11. The bar support of claim 9, said cap having a curved surface generally conforming to an outer surface of said second rebar.

* * * * *